US009782020B2

(12) United States Patent
Bacon

(10) Patent No.: US 9,782,020 B2
(45) Date of Patent: Oct. 10, 2017

(54) MERCHANDISE DISPLAY SHELVING UNIT

(71) Applicant: Stephen H Bacon, Farmington Hills, MI (US)

(72) Inventor: Stephen H Bacon, Farmington Hills, MI (US)

( * ) Notice: Subject to any disclaimer, the term of this patent is extended or adjusted under 35 U.S.C. 154(b) by 0 days.

(21) Appl. No.: 15/049,908

(22) Filed: Feb. 22, 2016

(65) Prior Publication Data

US 2017/0238726 A1 Aug. 24, 2017

(51) Int. Cl.

| | |
|---|---|
| ***A47B 43/00*** | (2006.01) |
| ***A47B 47/00*** | (2006.01) |
| ***A47B 57/00*** | (2006.01) |
| ***A47F 5/02*** | (2006.01) |
| ***A47F 5/06*** | (2006.01) |
| ***A47F 5/00*** | (2006.01) |
| ***A47F 5/10*** | (2006.01) |
| ***A47F 7/24*** | (2006.01) |
| ***A47B 57/18*** | (2006.01) |
| ***A47B 57/44*** | (2006.01) |

(52) U.S. Cl.

CPC ..... *A47F 5/06* (2013.01); *A47B 57/18* (2013.01); *A47B 57/44* (2013.01); *A47F 5/0018* (2013.01); *A47F 5/0062* (2013.01); *A47F 5/101* (2013.01); *A47F 7/24* (2013.01)

(58) Field of Classification Search

CPC ..... A47F 5/06; A47F 5/0018; A47F 5/0062; A47F 5/101; A47F 7/24; A47F 5/04; A47F 5/05; A47F 5/106; A47F 7/19; A47F 2005/0075; A47F 5/0087; A47F 5/02; A47F 7/14; A47F 7/144; A47F 7/145; D06F 57/04; A47B 57/00; A47B 57/06; A47B 57/16; A47B 57/18; A47B 57/20; A47B 57/30; A47B 57/40; A47B 57/402; A47B 57/44; A47B 57/48

USPC ..... 211/189, 196, 205, 197, 144, 187, 190, 211/207; 248/910; 108/147.11, 147.12, 108/149–151, 183; 312/15, 135, 305

See application file for complete search history.

(56) References Cited

U.S. PATENT DOCUMENTS

| | | | | | |
|---|---|---|---|---|---|
| 225,060 | A * | 3/1880 | Johnson | E04B 1/2604 | 211/196 |
| 348,271 | A * | 8/1886 | Eirick | A47F 5/04 | 108/50.11 |
| 1,466,191 | A * | 8/1923 | Roos | A47F 5/06 | 108/95 |
| 1,686,291 | A * | 10/1928 | Moore | A47B 49/00 | 108/101 |
| 1,788,096 | A * | 1/1931 | Friedemann | A47F 5/04 | 108/96 |
| 1,801,432 | A * | 4/1931 | Johnson | A47F 5/04 | 108/23 |

(Continued)

*Primary Examiner* — Jennifer E Novosad

(74) *Attorney, Agent, or Firm* — Heed Law Group PLLC; Thomas P. Heed

(57) ABSTRACT

A merchandise display shelving unit comprised of a perforated center support pole, a base, a plurality of shelf supports, and a plurality of shelf inserts. The shelf inserts nest inside the shelf supports. The shelf supports have a mating collar that attaches to the perforations of the center support pole through the use of fasteners. The shelf support and inserts can be a variety of shapes, such as round, square, triangular, and rectangular. The shelf supports and shelf inserts can be of incrementally decreasing size, so as to create a terraced effect.

17 Claims, 9 Drawing Sheets

(56) References Cited

U.S. PATENT DOCUMENTS 2,903,227 A * 9/1959 De Kalb Key .... A47B 96/1425 211/86.01
2,991,040 A * 7/1961 Levy ..... A47F 5/08 108/108
3,018,898 A * 1/1962 Frazelle ..... A47B 96/1425 211/107
3,035,708 A * 5/1962 Freeman ..... A47B 96/1425 108/147.19
3,080,067 A * 3/1963 Lind ..... A47F 5/04 211/190
3,194,403 A * 7/1965 Horn, Jr. ..... A47F 5/04 211/107
3,358,621 A * 12/1967 Szacsko ..... A47B 57/045 108/92
3,502,293 A * 3/1970 Bard ..... A47F 5/06 248/243
3,612,287 A * 10/1971 Maltese ..... A47F 5/04 211/182
3,739,919 A * 6/1973 Hochman ..... A47F 5/0815 211/194
4,010,698 A * 3/1977 Taub ..... A47B 87/0223 108/151
4,258,962 A * 3/1981 Slaugh ..... B25H 3/00 280/79.2
4,262,439 A * 4/1981 Dinan ..... A47B 57/265 211/128.1
4,480,882 A * 11/1984 Poltash ..... A47F 7/024 211/163
4,549,664 A * 10/1985 Gowan ..... B25H 3/06 206/508
4,643,104 A * 2/1987 Rasmussen ..... A47G 23/08 108/105
4,865,283 A * 9/1989 Parker ..... A47F 5/04 108/191
5,065,871 A * 11/1991 Chan ..... A43D 3/1491 12/128 B
5,078,283 A * 1/1992 Wilson ..... A47F 5/101 160/135
5,494,177 A * 2/1996 Todd, Jr. ..... A47F 5/04 211/115
5,499,726 A * 3/1996 Mitchell ..... A47F 5/16 211/183
5,505,319 A * 4/1996 Todd, Jr. ..... A47F 5/04 211/163
5,653,348 A * 8/1997 MacDonald ..... A47F 5/0807 211/87.01
5,690,239 A * 11/1997 Ballard ..... A47F 5/04 211/187
5,735,415 A * 4/1998 Wilson ..... A47B 57/42 211/187
6,138,842 A * 10/2000 Rios ..... A47F 5/10 211/133.4
6,505,749 B1 * 1/2003 Panetta ..... A47B 96/025 211/163
6,595,377 B1 * 7/2003 Hetu ..... A47F 7/0078 211/196
6,766,914 B1 * 7/2004 Rios ..... A47F 5/06 211/133.4
6,837,386 B1 * 1/2005 Kent ..... A47B 96/027 108/151
7,481,323 B2 * 1/2009 Fisher ..... B05B 13/0285 211/189
7,614,600 B1 * 11/2009 Smith ..... E04H 12/2246 135/16
8,051,994 B2 * 11/2011 Jin ..... A01N 1/0242 211/131.1
2004/0061419 A1 * 4/2004 Gallea ..... A47B 57/18 312/238
2004/0169114 A1 * 9/2004 Dierkes ..... F16M 13/02 248/165
2008/0156749 A1 * 7/2008 Shea ..... A47F 5/0018 211/7

* cited by examiner

MERCHANDISE DISPLAY SHELVING UNIT

FIELD OF INVENTION

This invention relates to the class of horizontally supported planar surfaces. Specifically, this invention relates to plural related horizontal surfaces, such as those used in merchandise display shelving units.

BACKGROUND OF INVENTION

Retail selling in the United States accounts for a substantial portion of the overall economy: the U.S. Census Bureau estimates that retail sales in January 2016 were $449 Billion. For the most recent full year reported, 2013, the U.S. Census Bureau estimated that annual retail and food sales at over $5 Trillion. This spending breaks down into thirteen (13) categories: Motor vehicle & parts dealers (around 20 percent of total sales), Food & beverage stores (13%), General merchandise stores (12.5%), Food services & drinking places (11%), Gasoline stations (10%), Nonstore retailers (9.2%), Building material & garden dealers (6%), Health & personal care stores (6%), Clothing & clothing accessories stores (5%), Miscellaneous store retailers (2.3%), Furniture stores (2%), Electronics & appliance stores (2%) and Sporting goods, hobby, book & music stores (1.7%). Seven of these categories, collectively referred to as Traditional Retailers, Food & beverage stores (13%), General merchandise stores (12.5%), Health & personal care stores (6%), Clothing & clothing accessories stores (5%), Miscellaneous store retailers (2.3%), Electronics & appliance stores (2%) and Sporting goods, hobby, book & music stores (1.7%) account for forty-two-and-a-half percent (42.5%) of the total, or approximately $2.13 Trillion in sales in 2013.

The Traditional Retailers share many commonalities with regards to store set-up, and the use and placement of displays, tables, and fixtures. Traditional retailers use a variety of retail displays: gondolas, two-way garment racks, four-way garment racks, rounder garment racks, spiral garment racks, built-in shelving, custom millwork, gridwall displays, display tables, and slatwall fixtures, inter alia. Perhaps, the most common type of retail merchandise display fixture is the gondola.

A gondola is a stand-alone fixture, consisting of a flat base and a planar vertical face with notches, pegboards, or slatwalls. The planar vertical face uses standard slats or notches to hold a plurality of shelf supports. The gondola is popular because it can moved (relatively) easily, and it can be re-configured. The down-side of gondolas is that they look common and cheap, and they often have sharp edges on the shelving and brackets.

Traditional Retailers like things that can be easily re-configured, as stock and seasons change. Additionally, Traditional Retailers like distinctiveness, both in stock and in the look of their store. This necessitates the ability to make common fixtures look distinctive, which is relatively difficult.

Most of the improvements made to display shelving for Traditional Retailers have been concerned with adding new electronics: electronic pricing labels, out-of-stock indicators, mobile advertising, and shelf lighting. Very little effort has been expended on improving the actual displays, themselves. The Traditional Retail market is vast. The Traditional Retail market has an unmet need for an easily re-configurable, and distinctive, floor display, which can at least partially displace the relatively lackluster gondolas and display tables currently in use.

PRIOR ART REVIEW

To truly meet the market demand, a retail fixture should be easily portable and re-configurable. Additionally, it should be easily modified for multiple distinctive appearances. There is substantial prior art in display shelving, but most of it is focused on improving gondolas or other traditional fixtures.

There is prior art related to gondolas. For example, U.S. Utility Pat. No. 6,357,609, by named inventors Van Nord, et. al, entitled, "Adjustable display shelf," (teaches an adjustable shelf depth mechanism for gondola); U.S. Utility Pat. No. 5,921,190, by named inventor Wood, entitled, "Modular display system," (teaches a variation of the traditional slotted shelf support used by a gondola); U.S. Utility Pat. No. 5,918,750, by named inventor Jackson, entitled, "Fixture for displaying merchandise," (teaches a combination of an H-frame vertical frame and a gondola); U.S. Utility Pat. No. 5,611,442, by named inventor Howard, entitled, "Gondola rack modular stacking system," (teaches a modular stacking system for shelves for use with a gondola); U.S. Utility Pat. No. 5,580,022, by named inventor Bach, entitled, "Display platform," (teaches a molded plastic base for use with a gondola); U.S. Utility Pat. No. 5,433,327, by named inventors Benvenuti, et. al., entitled, "Merchandise display rack with reinforced bases," (teaches using a tab to reduces the shear stresses on connecting hooks used in gondola base); U.S. Utility Pat. No. 5,427,255, by named inventor Nook, entitled, "Display system," (teaches a plurality of dividers, to create distinct merchandise spots, or cubby holes, for use with a gondola); U.S. Utility Pat. No. 5,390,802, by named inventors Pappagallo, et. al., entitled, "Merchandise display rack with reinforced bases," (teaches an adjustable divider to separate goods on the shelf of a gondola); and, U.S. Utility Pat. No. 4,919,282, by named inventors Duff, et. al., entitled, "Movable gondola shelving with hidden shelf adjustment mechanism," (teaches a movable gondola with hidden shelf adjustment); inter alia.

Some patents teach new variations on re-configurable, temporary or movable display fixtures. For example, U.S. Utility Pat. No. 7,171,909, by named inventor Alt, entitled, "Adjustable display racks," (teaches a multi-panel display that pivots about a horizontal pivot axes, allowing the panels to have variable angle or tilt); U.S. Utility Pat. No. 5,730,068, by named inventor Rioux, entitled, "Display table," (teaches a plurality of pivotable shelves that move in conjunction with a table top); U.S. Utility Pat. No. 5,599,079, by named inventors Ranno, et. al., entitled, "Product display stand, and method of storing and displaying products using the same," (teaches a display table with a plurality of tiltable shelves or drawers built underneath the main planar surface); U.S. Utility Pat. No. 4,981,226, by named inventors Shallenberg, et. al., entitled, "Merchandise display assembly," (teaches multi-leveled, adjustable, canopied, shelving using standard slotted shelf supports); and U.S. Utility Pat. No. 4,865,283, by named inventor Parker, entitled, "Merchandising display stand," (teaches mounting adjustable racks or trays on a weighted pole, which has a plus-shaped cross-section); inter alia.

There is substantial additional prior art that teach things like angling and spring-loading shelving to feed product (shelf dividers and product pushers); product management and information management system; and mounting and displaying of signage. There is clearly still a market need for an easily reconfigurable merchandise display system, allowing for a variety of appearances and product offering utilities.

SUMMARY OF THE INVENTION

This summary is intended to disclose the present invention, a merchandise display shelving unit, by illustrating various standard embodiments. The embodiments and descriptions are used to illustrate the invention and its utility, and are not intended to limit the invention or its use. The present invention is easily re-configurable both in appearance and utility. The present invention is a retail shelving unit that is easily moved and re-positioned. The shelving can be changed to accommodate goods of different sizes and nature. The appearance of the shelving is easily changed. The entire unit is re-positionable with minimum effort. The merchandise display shelving unit does not have any sharp edges on which associates can cut themselves.

The present invention is a merchandise display shelving unit that relies on a perforated center support pole as the mounting locus for a plurality of shelves or supports. The perforated center support pole terminates in a weighted base, in order to make the unit stable. The weighted base has embodiments mounted on caster wheels and adjustable legs. The weighted base has a decorative wrap that is held in place with magnets. The decorative wrap can be a faux wood finish, metallic finish, or colored plastic finish.

The perforated center support pole is fabricated from common structural materials. The perforated center support pole can be fabricated from structural plastic, such as poly(methyl-methacrylate) ("PMMA"), polycarbonate ("PC"), acrylonitrile butadiene styrene ("ABS"), polypropylene ("PP"), high-density polyethylene ("HDPE"), or low-density polyethylene ("LDPE"). The perforated center support pole can be fabricated from metal, such as stainless steel, chrome steel, aluminum, steel, copper, brass, or tin. Additionally, the perforated center support pole can be fabricated from a metal alloy of one or more of stainless steel, chrome steel, aluminum, steel, copper, brass, and tin. Last, the perforated center support pole can be fabricated from wood. The perforated center support pole can be finished to give a preferred aesthetic appearance. The finishes can include, but are not limited to, brushed metal finishes, painted finishes, stained wooden finishes, and a colored plastic finishes.

Typically, the perforated center support pole has perforations, or holes substantially along its entire length and circumference. For aesthetics and/or utility, the perforated portion of the center support pole can be limited to just a portion of the entire length of the perforated center support pole. The perforated portion of the perforated center support pole has at least 9 holes per square inch. The perforated portion of the perforated center support pole has an open area ratio of at least 20%. The open area ratio is defined as the summation of the area of the holes divided by the total area of perforated portion of the perforated center support pole. In the preferred embodiment, the perforations are arranged in alternating, offset rows. However, this is not a requirement, although the perforations must be arranged in rows that reside in the same plane that is orthogonal to the long-axis of the perforated center support pole. The spacing between any two adjacent rows is measured from the centerline of each row, and is referred to as the hole row spacing.

A plurality of shelf supports can be fitted or attached to the perforated center support pole. The plurality of shelf supports is comprised of a perimeter, a plurality of spokes, and a center support mating collar. The center of the center support mating collar is usually located at the center of mass of the shelf support. However, this is not a requirement. The plurality of shelf supports can be round, square, triangular, rectangular, elliptical, or any other shape. The perimeter of the shelf support has a largely circular cross-section. This allows the perimeter of the shelf support should have a cross-section that allows it to be used as a hanging bar for hanging clothes. Such a cross section may be, but is not limited to, rectangular, circular, or elliptical. The perimeter of the shelf support usually is proud, or raised, with respect to the spokes. The perimeter has an outer facing surface, that will be visible to shoppers.

The plurality of shelf supports can be manufactured from a variety of structural materials: wood, PMMA, PC, ABS, PP, HDPE, LDPE, stainless steel, chrome steel, aluminum, steel, copper, brass, tin, or an alloy one or more of stainless steel, chrome steel, aluminum, steel, copper, brass, and tin. The plurality of shelf supports can be finished to give a preferred aesthetic appearance. The finishes can include, but are not limited to, brushed metal finishes, painted finishes, stained wooden finishes, and a colored plastic finishes. Logos, designs, trademarks, and other commercial messages can be printed on the outer surface of the perimeter of the shelf supports.

The shelf support is attached to the perforated center support pole with a center pole mating collar. The center pole mating collar has fasteners that engage with the holes of the perforated center support pole. The fasteners can include, but are not limited to, self-centering machine screws and spring-loaded pins. The center pole mating collar inner radius is no larger than the outer radius of the perforated center support pole plus three times the hole row spacing. The top and bottom of the inner surface of the center pole mating collar can be tapered in order to facilitate moving the collar up and down the perforated center support pole.

A plurality of shelf inserts nest inside the perimeter of the plurality of shelf supports. Each shelf insert is comprised of a top surface, a bottom surface, an outer radius, and an inner radius. The inner radius fits over the perforated center support pole. The outer radius fits inside of the perimeter of the shelf support, allowing the shelf insert to nest inside the shelf support. The plurality of shelf inserts can be round, square, triangular, rectangular, elliptical, or any other shape, mimicking the shape of the shelf supports.

The plurality of shelf inserts can be manufactured from a variety of structural materials: wood, PMMA, PC, ABS, PP, HDPE, LDPE, stainless steel, chrome steel, aluminum, steel, copper, brass, tin, or an alloy one or more of stainless steel, chrome steel, aluminum, steel, copper, brass, and tin. The plurality of shelf inserts can be finished to give a preferred aesthetic appearance. The finishes can include, but are not limited to, brushed metal finishes, painted finishes, stained wooden finishes, and a colored plastic finishes. Logos, designs, trademarks, and other commercial messages can be printed on the either surface of the shelf inserts. By printing or decorating two sides of the shelf insert, the appearance of a merchandise display shelving unit can be easily and quickly changed.

Both the plurality of shelf supports and the plurality of shelf inserts used in a merchandise display shelving unit can be sized in matching, increasing increments so as to give the merchandise display shelving unit a terraced effect.

BRIEF DESCRIPTION OF THE DRAWINGS

The present invention is illustrated with 12 drawings on 9 sheets.

DETAILED DESCRIPTION OF THE DRAWINGS

The following descriptions are not meant to limit the invention, but rather to add to the summary of invention, and illustrate the present invention, a Merchandise Display Shelving Unit. The present invention is illustrated with a variety of drawings showing various possible embodiments.

Figure 2:
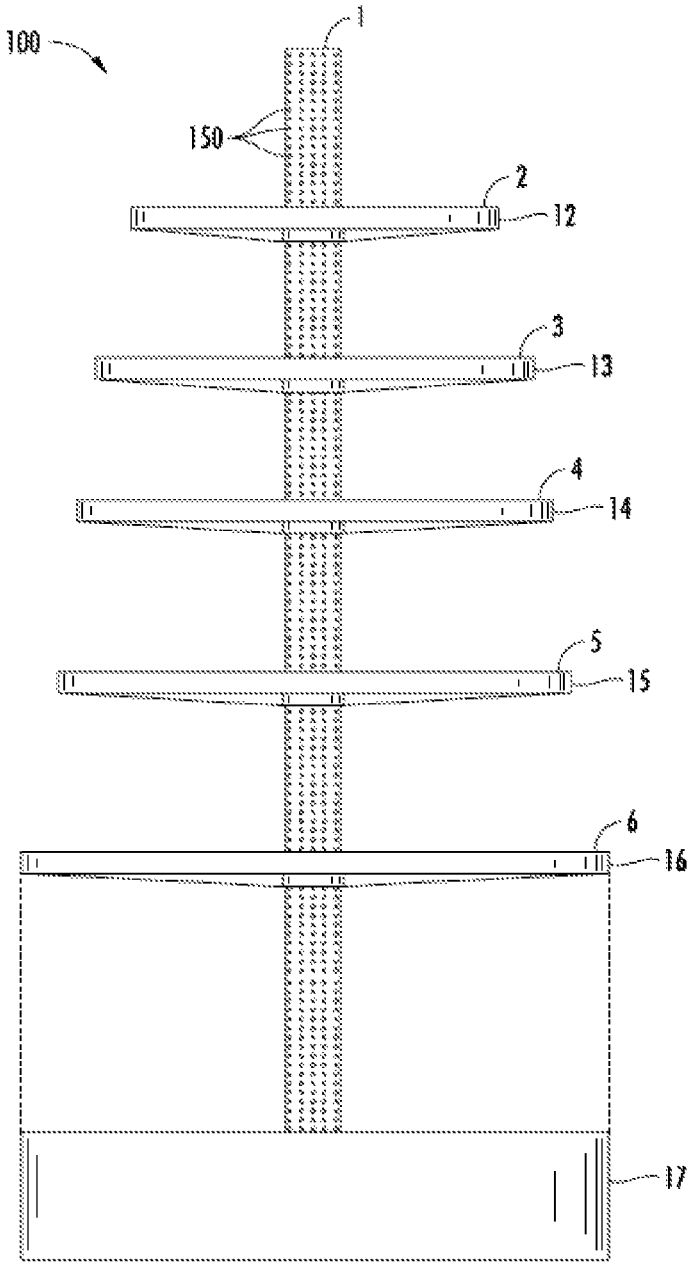
FIG. 2 is a lateral view of a Merchandise Display Shelving Unit.

FIG. 2 shows a lateral view of the present invention 100, a Merchandise Display Shelving Unit. The present invention has a perforated center support pole 1 constructed from a perforated tube. The perforated center support pole 1 can be constructed out of stainless steel, chrome steel, aluminum, steel, copper, tin, or an alloy one or more. The perforated center support pole 1 can also be constructed out of rigid, structural plastic such as poly(methyl-methacrylate) ("PMMA" or trade names Plexiglas or Lucite®), polycarbonate ("PC" or trade name Lexan®), acrylonitrile butadiene styrene ("ABS"), polypropylene ("PP"), high-density polyethylene ("HDPE"), or low-density polyethylene ("LDPE"). For aesthetics, a lighting source can be placed inside the perforated center support pole 1, illuminating the perforations 150.

The perforated center support pole 1 holds a plurality of shelf supports 12, 13, 14, 15, 16. The shelf supports 12, 13, 14, 15, 16 support a plurality of shelf inserts 2, 3, 4, 5, 6. The shelf inserts 2, 3, 4, 5, 6 map onto the shelf supports 12, 13, 14, 15, 16 is a one-to-one fashion (e.g., 2 is paired with 12, 3 is paired with 13). The shelf supports 12, 13, 14, 15, 16 can be fabricated from a variety of metals such as stainless steel, chrome steel, aluminum, steel, copper, tin, or an alloy one or more. The shelf supports 12, 13, 14, 15, 16 can also be constructed out of rigid, structural plastic such as PMMA, PC, ABS, PP, HDPE, or LDPE. The shelf supports 12, 13, 14, 15, 16 can also be constructed from wood, including wood solids, particle board, and laminated particle board. The shelf supports 12, 13, 14, 15, 16 can also be decorative in nature, with brushed metal finishes, finished wood laminates, paint, or colored plastic. The shelf inserts 2, 3, 4, 5, 6 can be fabricated from a variety of metals such as stainless steel, chrome steel, aluminum, steel, copper, brass, tin, or an alloy one or more. The shelf inserts 2, 3, 4, 5, 6 can also be constructed out of rigid, structural plastic such as PMMA, PC, ABS, PP, HDPE, or LDPE. The shelf inserts 2, 3, 4, 5, 6 can also be constructed from wood, including wood solids, particle board, and laminated particle board. The shelf inserts 2, 3, 4, 5, 6 can be decorative in nature, being covered with brushed metal finishes, finished wood laminates, paint, or colored plastic. The bottom of the present invention 100 can be wrapped in a laminated or decorative wrap 17.

Figure 1:
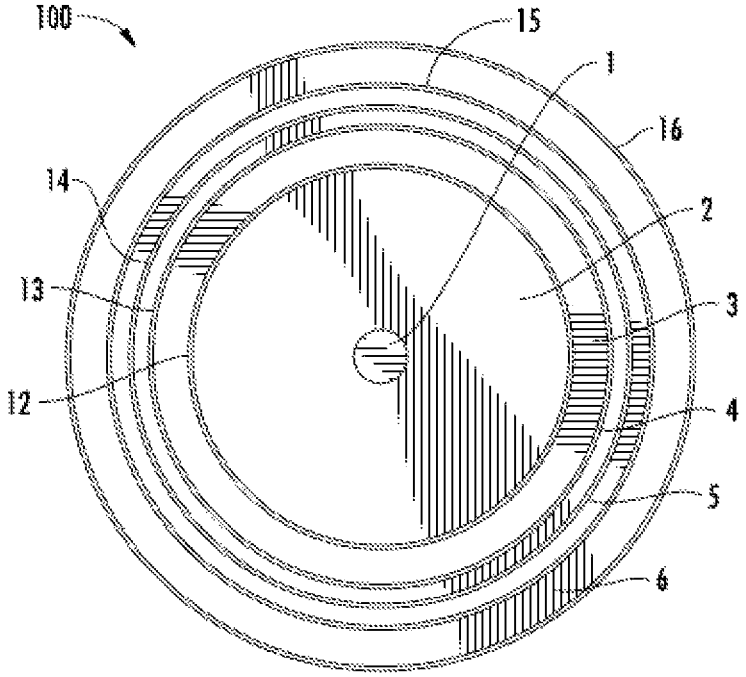
FIG. 1 is a top view of a Merchandise Display Shelving Unit.

FIG. 1 shows a top view of the present invention 100. The terraced nature of the present embodiment of the present invention 100 is visible. The perforated center support pole 1 is surrounded by the shelf supports 12, 13, 14, 15, 16 and shelf inserts 2, 3, 4, 5, 6.

Figure 12:
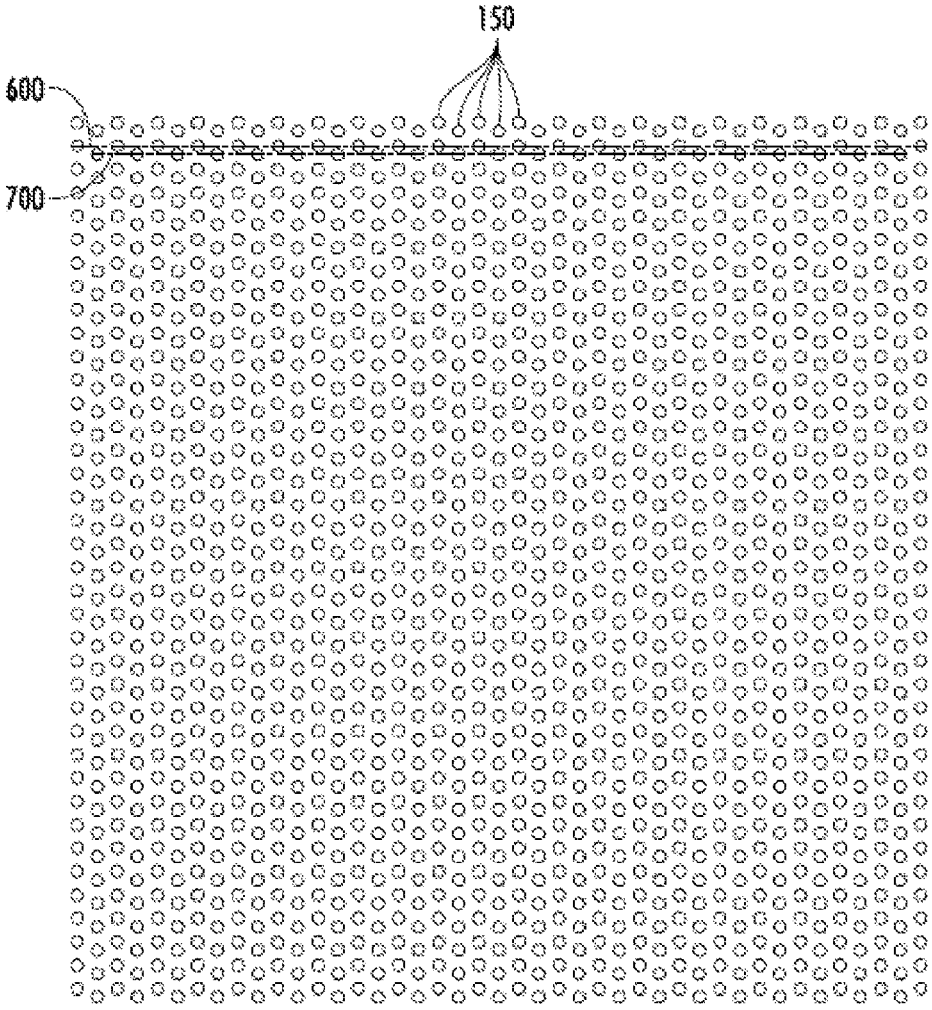
FIG. 12 is an isolation of perforations.

FIG. 12 is an isolation of a typical embodiment of the perforations 150. The perforations 150 are arranged in alternating, offset rows 600, 700. The distance between the centerline of two adjacent rows 600, 700, is the hole row spacing. The perforations 150 should be greater than 9 holes per square inch. The open area ratio of the perforation 150 should be 20% or more. The open area ratio is the summation of the area of the holes divided by the area of the portion of the perforated center support pole 1 that has perforations.

Figure 3:
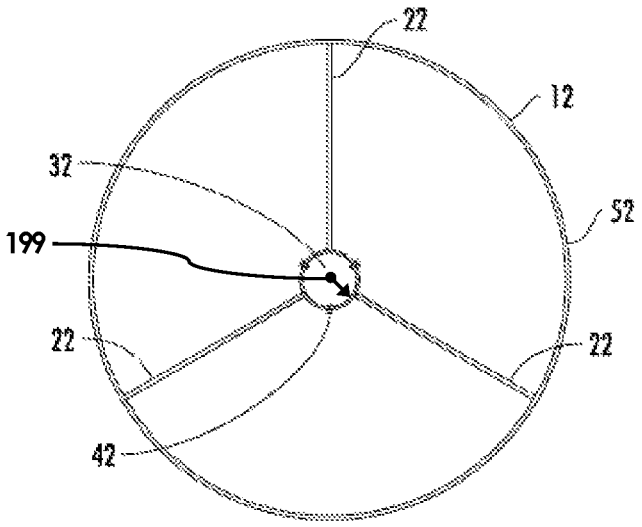
FIG. 3 is a top view of a shelf support for the Merchandise Display Shelving Unit.
Figure 4:
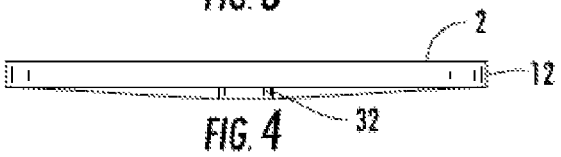
FIG. 4 is a lateral view of a shelf support for the Merchandise Display Shelving Unit.

FIGS. 3-4 show a shelf support 12. The shelf support 12 has a perimeter 52 to which are attached a plurality of spokes 22. The spokes terminate at a support mating collar 32. The support mating collar 32 has an inner radius 199, and fasteners 42 that mate with the perforations 150, securing the shelf support 12 in place on the perforated center support pole 1.

Figure 5:
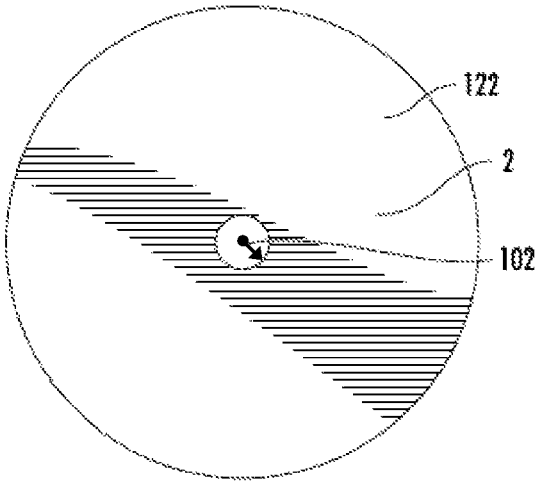
FIG. 5 is a top view of a shelf insert for the Merchandise Display Shelving Unit.
Figure 6:
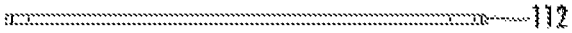
FIG. 6 is a lateral view of a shelf insert for the Merchandise Display Shelving Unit.

FIGS. 5-6 show a shelf insert 2. The shelf insert has a top planar surface 122, a bottom planar surface (not visible), an outer radius 112, and an inner radius 102. The inner radius 102 fits over the perforated center support pole 1, centering the shelf insert 2. The shelf insert 2 is supported by the shelf support 12, specifically, the spokes 22 of the shelf support 12. The shelf insert 2 nests inside the shelf support 12, with the outer radius 122 of the shelf insert 2 fitting inside the shelf support 12 perimeter.

Logos, images, trademarks, or word phrases can be printed, permanently or temporarily, on the perimeter 52 of the plurality of shelf supports 12 and on the top 122 and bottom planar surfaces of the shelf inserts 2. The logos, images, trademarks, or word phases can be printed so that they deliver a single message when all of the perimeters 52 of all of the shelf supports 12 are read together. The plurality of shelf supports 12 and shelf inserts 2 can be round (as shown), or, in alternative embodiments, square, triangular, rectangular, elliptical, or any other practicable shape.

Figure 7:
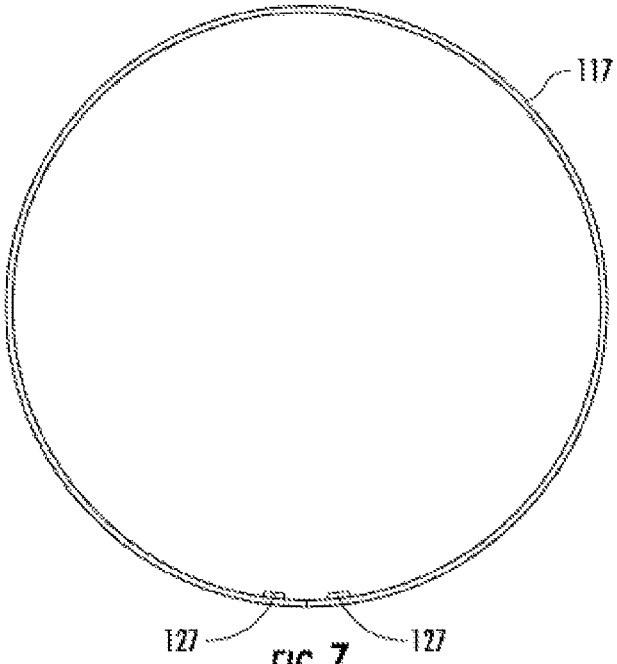
FIG. 7 is a top view of a decorative wrap for the base of the Merchandise Display Shelving Unit.
Figure 8:
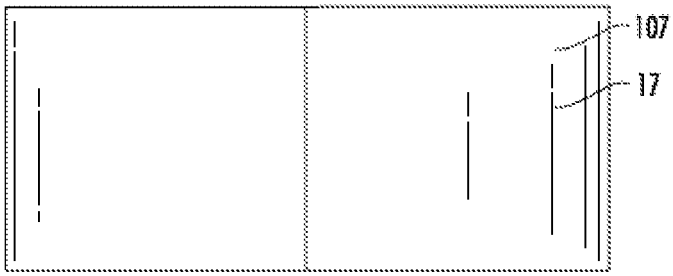
FIG. 8 is a side view of a decorative wrap for the base of the Merchandise Display Shelving Unit.

FIGS. 7-8 show a decorative wrap 17 that encircles the bottom or base of the invention 100. The decorative wrap 17 has an external decorative surface 107 and a top surface 117. The decorative wrap 17 is held in place by magnets 127.

Figure 9A:
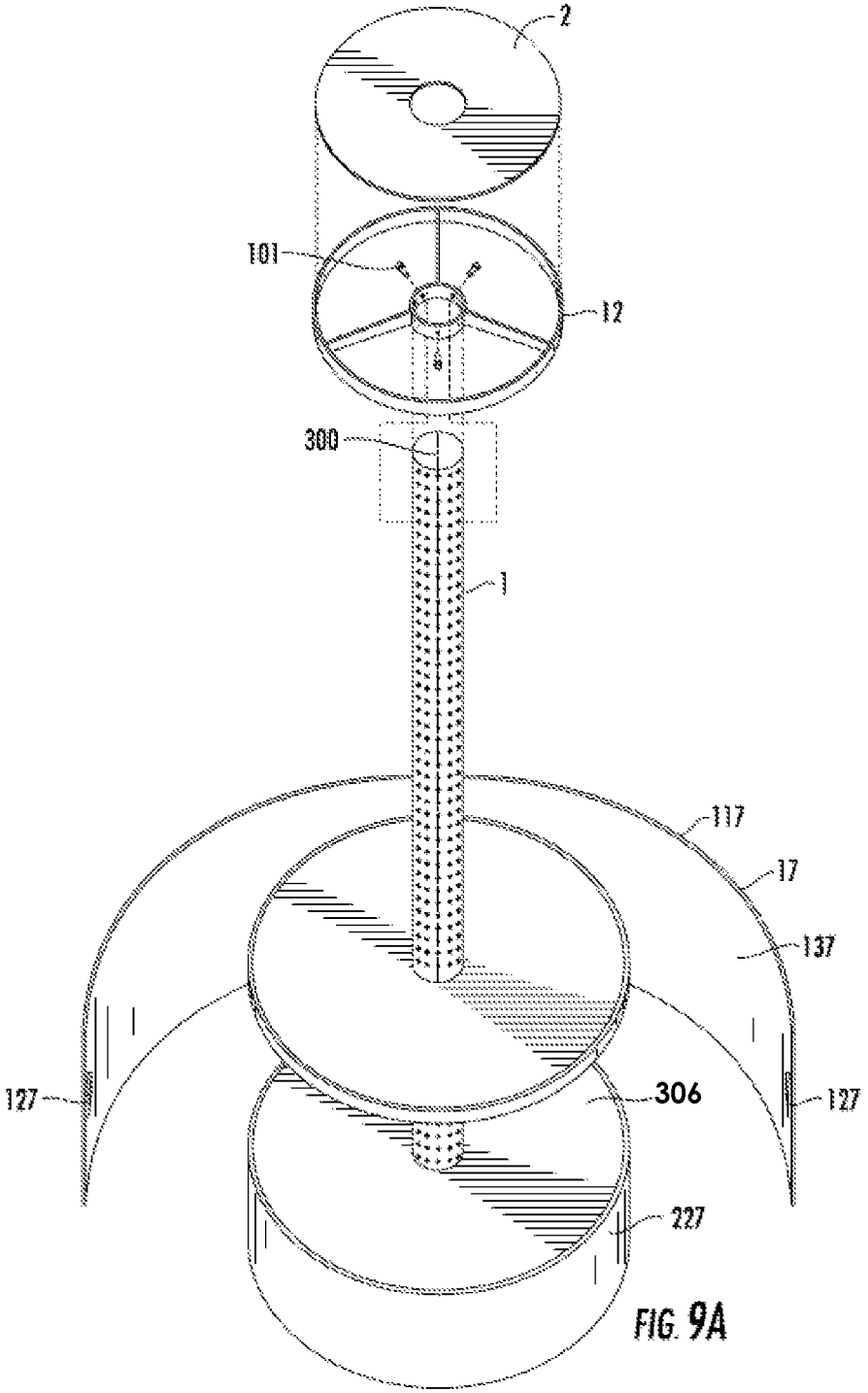
FIG. 9A is an exploded isometric drawing of the Merchandise Display Shelving Unit.

FIG. 9A is an exploded view of the invention 100. The shelf insert 2 nests into the shelf support 12. The shelf support 12 fits over the perforated center support pole 1. The shelf support 12 is held in place with fasteners 101. The fasteners 101 fit into the holes 42 in the support mating collar 32; and the holes 150 in the perforated center support pole 1. The fasteners 101 can be self-centering machine screws, other self-centering screws, spring-loaded pins, or slide pins. The perforated center support pole 1 terminates in the weighted base 227. The inner surface 137 of the decorative wrap 17 wraps around the weighted base 227, and is held in place with the magnets 127. The top of the base 227 is a shelf 306.

Figure 9B:
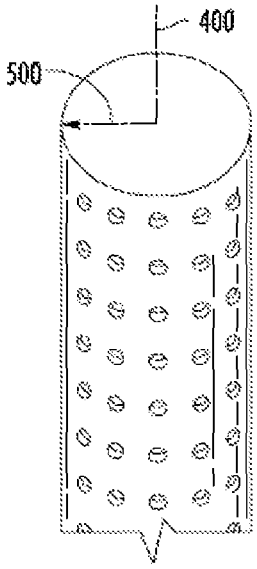
FIG. 9B is an isometric isolation of the perforated center support pole.

FIG. 9B is an isometric isolation of the perforated center support pole. The perforated center support pole 1 has a radius 500 and a long-axis 400. The maximum radius 199 of the support mating collar 32 is the radius 500 of the perforated center support pole 1 plus three times the hole row spacing 600, 700.

Figure 10:
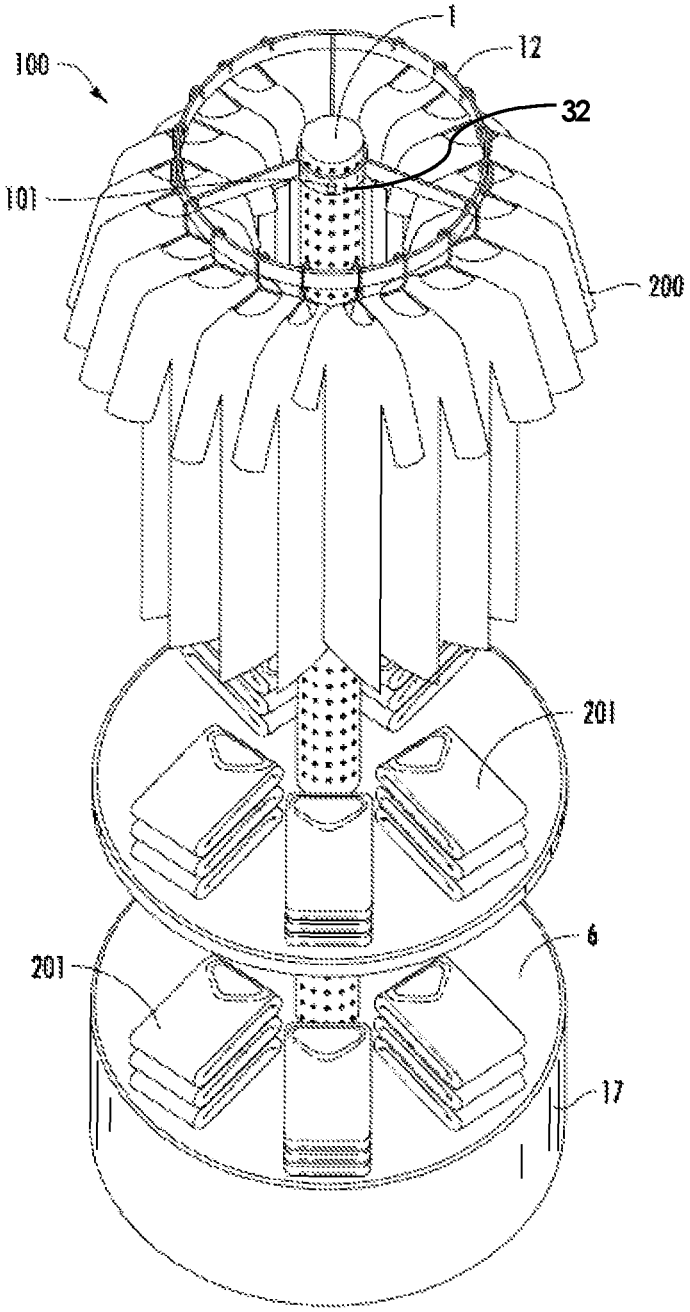
FIG. 10 is an isometric in situ drawing of the Merchandise Display Shelving Unit.

FIG. 10 shows the present invention 100 in situ. A shelf support 12 is held in place at the top of the perforated center support pole 1 with fasteners 101 through the support mating collar 32. Hanging clothes 200 can be hung around the perimeter 52 of the shelf support 12. Folded clothes 201 can be placed on the plurality of shelf inserts 6. The decorative wrap 17 covers the base 227.

Figure 11:
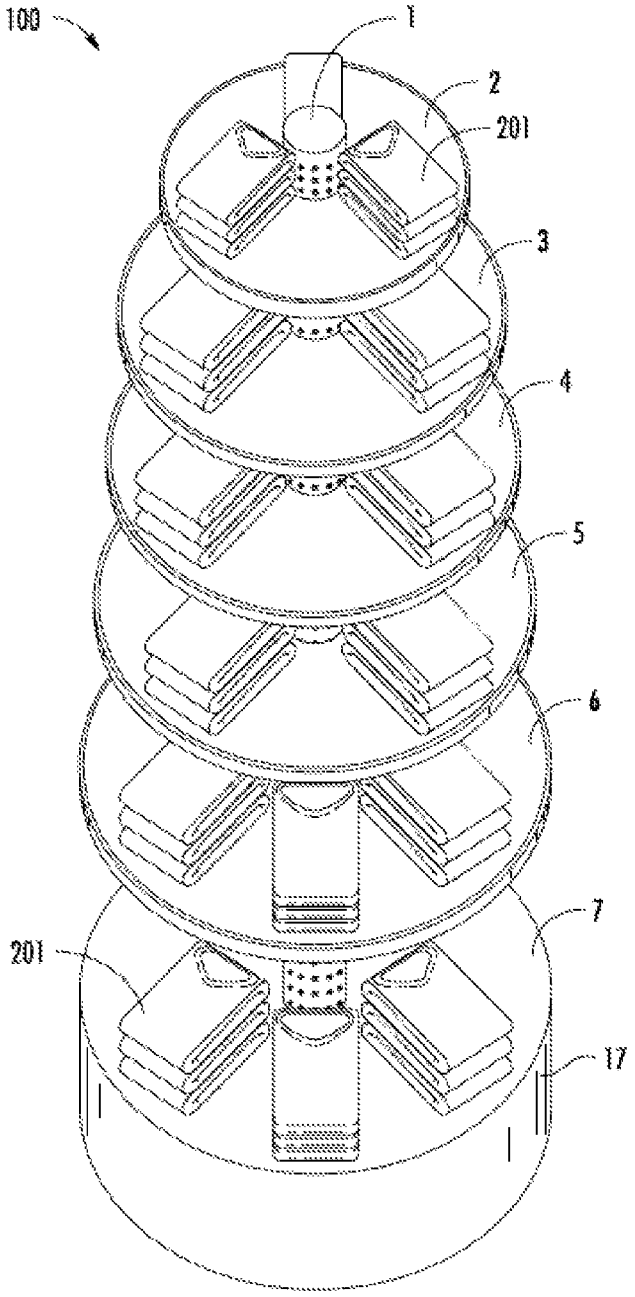
FIG. 11 is an alternative isometric in situ drawing of the Merchandise Display Shelving Unit.

FIG. 11 is an alternative embodiment of the present invention 100 in situ. The plurality of shelf inserts 2, 3, 4, 5, 6, 7 fit over the perforated center support pole 1. The folded clothes 201 can be place on the plurality of shelf inserts 2, 3, 4, 5, 6, 7. The decorative wrap 17 covers the base 227.

I claim:

1. A merchandise display shelving unit, comprising a perforated center support pole, wherein the perforated center support pole has a radius, circumference, and an axial length, wherein the perforations are a plurality of holes that cover the circumference of the perforated center support pole along at least a portion of its axial length; and wherein the holes are all the same size;

a plurality of shelf supports;

a plurality of shelf inserts;

a base;

and a decorative base wrap;

wherein each shelf support is comprised of a perimeter, annular center support mating collar with an inner radius, and a plurality of spokes connecting the perimeter to the center support mating collar;

wherein the shelf inserts map onto the shelf supports in a one-to-one fashion;

wherein each shelf insert nests inside its respective shelf support perimeter;

wherein the center support mating collar fits over, and can be fastened to, the perforated center support pole; and wherein the base is weighted so as to give the merchandise display shelving unit stability.

2. The merchandise display shelving unit of claim 1, wherein the perforated center support pole has a perforated portion and an unperforated portion along its axial length.

3. The merchandise display shelving unit of claim 2, wherein the holes constituting perforations are arranged in rows around the circumference of the perforated center support pole; and wherein the centerline of each row of perforations lies in a plane perpendicular to the axial length of the perforated center support pole.

4. The merchandise display shelving unit of claim 3, wherein the perforated portion of the perforated center support has 9 or more holes per square inch.

5. The merchandise display shelving unit of claim 3, wherein the perforations are arranged in offset rows.

6. The merchandise display shelving unit of claim 3, wherein the distance between the centerline of two adjacent rows of perforations is the hole row spacing; and wherein the inner radius of the center support mating collars of the plurality of shelf supports is no larger than the sum of the radius of the perforated center support pole plus three times the hole row spacing.

7. The merchandise display shelving unit of claim 1, wherein the perforated center support pole is fabricated from at least one of wood, poly(methyl-methacrylate) ("PMMA"), polycarbonate ("PC"), acrylonitrile butadiene styrene ("ABS"), polypropylene ("PP"), high-density polyethylene ("HDPE"), low-density polyethylene ("LDPE"), stainless steel, chrome steel, aluminum, steel, copper, brass, tin, or an alloy one or more of stainless steel, chrome steel, aluminum, steel, copper, brass, and tin.

8. The merchandise display shelving unit of claim 1, wherein the plurality of shelf supports are fabricated at least one of wood, PMMA, PC, ABS, PP, HDPE, LDPE, stainless steel, chrome steel, aluminum, steel, copper, brass, tin, or an alloy one or more of stainless steel, chrome steel, aluminum, steel, copper, brass, and tin.

9. The merchandise display shelving unit of claim 8, wherein the plurality of shelf supports has at least one of a brushed metal finish, a painted finish, a stained wooden finish, and a colored plastic finish.

10. The merchandise display shelving unit of claim 1, wherein the plurality of shelf inserts is fabricated out of at least one of wood, PMMA, PC, ABS, PP, HDPE, LDPE, stainless steel, chrome steel, aluminum, steel, copper, brass, tin, or an alloy one or more of stainless steel, chrome steel, aluminum, steel, copper, brass, and tin.

11. The merchandise display shelving unit of claim 10, wherein the top surface of the plurality of shelf inserts has at least one of a brushed metal finish, a painted finish, a stained wooden finish, or a colored plastic finish.

12. The merchandise display shelving unit of claim 10, wherein the top surface of the plurality of shelf inserts has at least one of a brushed metal finish, a painted finish, a stained laminate wooden finish, or a colored plastic finish; wherein the bottom surface of the plurality of shelf inserts has at least one of a brushed metal finish, a painted finish, a stained wooden finish, or a colored plastic finish; and wherein the finish of the top surface and the finish of the bottom surface are different.

13. The merchandise display shelving unit of claim 1, wherein the perimeter of the shelf supports and the shelf inserts are round.

14. The merchandise display shelving unit of claim 1, wherein the plurality of shelf supports and the plurality of shelf inserts are of incrementally increasing area, creating a terraced effect when mounted on the perforated center support pole.

15. The merchandise display shelving unit of claim 1, wherein the plurality of the shelf supports' center support mating collars are held in place about the perforated center support pole with fasteners.

16. The merchandise display shelving unit of claim 15, wherein the fasteners are self-centering machine screws.

17. The merchandise display shelving unit of claim 15, wherein the fasteners are spring-loaded pins.

* * * * *